United States Patent [19]

Gloss et al.

[11] Patent Number: 4,556,036

[45] Date of Patent: Dec. 3, 1985

[54] METHOD OF AND DEVICE FOR CONTROLLING AFTER-START ENRICHMENT OF INTERNAL COMBUSTION ENGINE

[75] Inventors: Erwin Gloss, Korntal; Gerhard Lotterbach, Markgröningen; Egbert Perenthaler, Stuttgart; Manfred Schenk, Schorndorf; Jan F. Van Woudenberg, Markgröningen; Udo Zucker, Bönnigheim, all of Fed. Rep. of Germany

[73] Assignee: Robert Bosch GmbH, Stuttgart, Fed. Rep. of Germany

[21] Appl. No.: 626,622

[22] Filed: Jul. 2, 1984

[30] Foreign Application Priority Data

Jul. 23, 1983 [DE] Fed. Rep. of Germany ..... 3326575

[51] Int. Cl.[4] ..... F02D 5/02

[52] U.S. Cl. ..... 123/491

[58] Field of Search ..... 123/491, 179 L, 179 G

[56] References Cited

U.S. PATENT DOCUMENTS 4,239,022 12/1980 Drews et al. ..... 123/491
4,432,325 2/1984 Auracher et al. ..... 123/491
4,444,173 4/1984 Yamato et al. ..... 123/491

FOREIGN PATENT DOCUMENTS 2522283 12/1976 Fed. Rep. of Germany .

*Primary Examiner*—Andrew M. Dolinar
*Attorney, Agent, or Firm*—Michael J. Striker

[57] ABSTRACT

Injection control pulses after starting the engine are multiplied by a fuel enrichment factor $A_1$ depending on operational temperature and rotary speed of the engine. The time derivative $-A/t$ of the enrichment factor is kept constant up to a predetermined rotary speed limit. When the speed limit is exceeded, the time derivative increases proportionally with the rotary speed increase. In this manner faster warm-up of the engine due to higher speeds influences the fuel enrichment phase.

5 Claims, 5 Drawing Figures

METHOD OF AND DEVICE FOR CONTROLLING AFTER-START ENRICHMENT OF INTERNAL COMBUSTION ENGINE

BACKGROUND OF THE INVENTION

The invention relates in general to fuel injection control of an internal combustion engine and in particular to a method of and a device for controlling the after-start fuel enrichment of the engine which is supplied with fuel-air mixture via a fuel injection system including injection valves and a control circuit generating injection control pulses whose duration during the after-start enrichment phase is increased to a value corresponding to a product of the duration of injection control pulses required for normal operation of the engine, and an enrichment factor depending on operational parameters of the engine.

From the German patent publication DE-AS No. 2522 283 assigned to the same assignee, an injection control circuit is known by means of which the duration of the after-start enrichment pulses is controlled in response to the rotary speed and to the load of the engine.

The disadvantage of this prior art device is a relatively large consumption of fuel.

SUMMARY OF THE INVENTION

A general object of this invention is to overcome this disadvantage and to provide an injection control device which improves the fuel requirement during the after-start operational phase of the engine.

In keeping with this object and others which will become apparent hereafter, one feature of the invention resides in the provision of a control device of the before described kind in which the control circuit includes means for setting the enrichment factor A at the beginning of the enrichment phase to a value $A_o > 1$ which depends on the temperature of cool engine means for reducing during the enrichment phase this initial value to $A = 1$; means for keeping a constant time derivative of the enrichment factor until a predetermined rotary speed limit of the engine is reached; and means for reducing the time derivative in proportion with the rotary speed when the speed limit is exceeded.

The advantage of the device of this invention is in the feature that the control circuit responds to different warm-up times of the engine depending on different rotary speeds.

In a four-cylinder engine the rotary speed limit is between 3400 and 3800 rotations per minute (preferably 3600 rpm), in a five cylinder engine between 2700 and 3100 rpm (preferably 2880 rpm), and in a six cylinder engine between 2200 and 2600 rpm (preferably about 2400 rpm).

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 4:
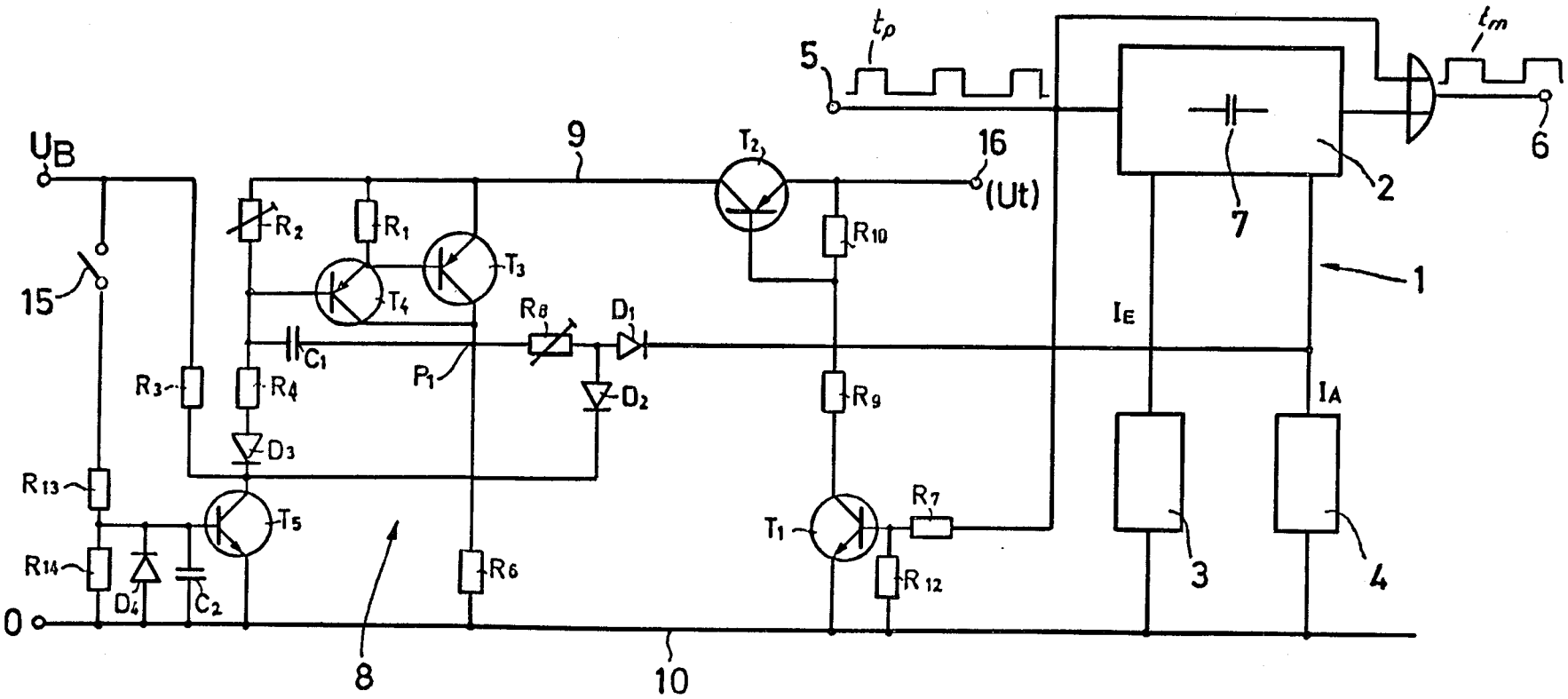
FIG. 4 is a prior art injection control circuit of a fuel injection system modified in accordance with this invention.

Referring firstly to FIG. 4 there is illustrated the part of a prior art fuel injection system in which this invention is included. The shown circuit includes a control multivibrator 2 which generates at the output terminal 6 injection control pulses $t_m$ whose duty cycle and/or duration is a function of operational parameters of the engine. The multivibrator 2 includes a monostable multivibrator which is triggered in response to a load of a timing capacitor 7 which in turn is controlled by a source 3 of a discharging direct current $\mathbf{1}_E$ and a source 4 of a constant charging current $I_A$ in a multiplying stage 1. The control pulses $t_p$ to be modified in accordance with this invention are supplied to input 5 of multivibrator 2 from a non-illustrated injection control circuit including a similar controlling multivibrator which generates the pulses $t_p$ of a duration which is determined by the rotary speed of the engine.

The amount of currents $\mathbf{1}_A$ and $\mathbf{1}_E$ into and from the capacitor 7 is controlled by an after-start controlling circuit 8 which is responsive to the engine temperature and rotary speed as it will be explained below. The circuit 8 includes an integrator constituted by Darlington amplifier $T_3$, $T_4$ connected to power supply conduits 9 and 10 via a resistor R1 and R6, and a capacitor C1 connected between the base of transistor T4 and the collector of transistor T3. A protective switching transistor T5 is connected to the base of transistor T4 via a series connection of a diode D3 and resistor R4. The base of switching transistor T5 is connected to voltage source $U_B$ through a voltage divider R13, R14 and a switch 15. Switch 15 is closed during starting of the engine so that transistor T5 is also switched on, whereas after turning off the switch 15 transistor T5 is also turned off. A control voltage $V_t$ supplied from an engine temperature sensor is applied directly to the emitter of transistor T2 and via a voltage divider R10, R9 to transistor T1. Collector of transistor T2 is connected to supply conduit 9 and the base electrode of transistor T2 to the center point of voltage divider R10, R9. The base electrode of transistor T1 is connected to the input terminal 5 of multivibrator 2 and to one input of an AND gate whose other input is connected to the output of multivibrator 2 and whose output is connected to output terminal 6. In this manner, transistor T2 is rendered conductive in dependency on switching condition of transistor T1. As a result, during the duration of pulses $t_p$ control voltage $V_t$ is applied via transistor $T_2$ to supply conduit 9 of integrator T3, T4 and C1. The output current $I_z$ from the integrator is delivered from the collector of transistor T4 via adjustable resistor R8 and diode D1, to the output of current source 4 where it is added to loading current $I_A$ for capacitor 7 of monostable multivibrator 2 and, consequently, the duration of output pulses $t_m$ is modified in accordance with the applied control voltage $V_t$. The adjustable resistor R8 adjusts the value of the additional current $I_z$. After starting the engine, switch 15 is open, transistor T5 becomes non-conductive and transistor T4 receives its base current from capacitor C1 and simultaneously potential on collectors of transistors T4 and T3 is increased. Depending on the value of applied voltage to collector-emitter path of transistor T3, a maximum potential difference at collector of transistor T3 decreases linearly toward ground potential at conduit 10 and the control current $I_z$ decreases accordingly. By a suitable dimensioning of circuit components, the fade-out time can be adjusted to an arbitrary value up to 60 seconds.

In pulsing the power supply voltage between conduits 9 and 10 by input pulses $t_m$ indicative of the rotary speed of the engine and by sensed temperature dependent voltage $V_t$, the loading time of integrating capacitor C1 and hence the duration of the fuel enrichment factor of the engine, are made dependent on the sensed engine temperature and rotary speed.

Figure 1:
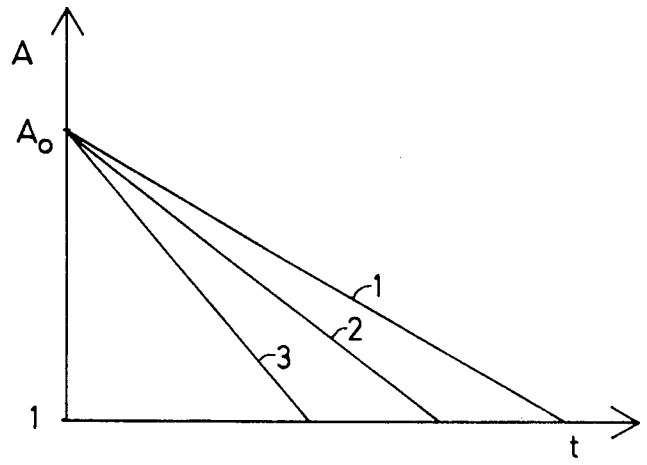
FIG. 1 is a time plot diagram of an enrichment factor for different constant rotary speeds of the engine.

FIG. 1 shows a diagram in which the abscissa denotes time t measured from the beginning of the fuel enrichment phase after start, and the ordinate denotes values of the fuel enrichment factor. As mentioned before, the enrichment factor represents a value by which the duration of injection pulses for normal operational phase is to be multiplied during the after-starting phase. The initial value $A_o$ at the time point $t=0$ depends on sensed temperature of a cooling medium of the engine and/or on ambient temperature. Provided that rotary speed of the engine is constant, the value of the enrichment factor $A_o$ decreases linearly during the after-start enrichment period t to a value $A=1$ at which the normal duration of speed dependent injection pulses $t_m$ is no longer influenced by temperature. In FIG. 1, line 1, having the smallest gradient pertains to all rotary speeds which are lower than a predetermined rotary speed limit. Lines 2 and 3 pertain to different constant rotary speeds above this speed limit. It will be seen that in increasing rotary speed above this speed limit the time behavior of the enrichment factor A has a correspondingly increased gradient.

Figure 2:
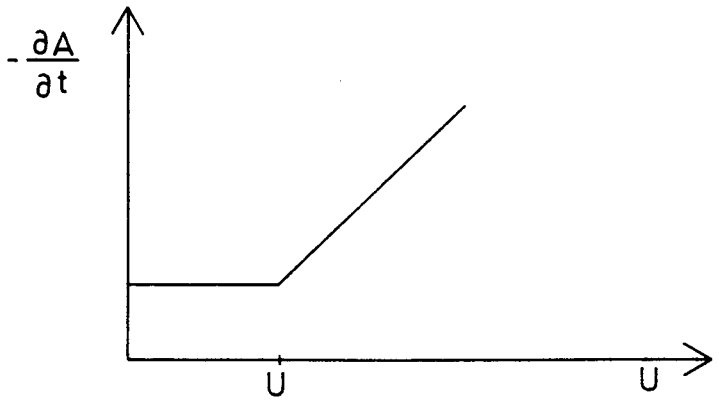
FIG. 2 is a plot diagram of a time derivative of an enrichment factor versus rotary speed.

FIG. 2 illustrates the relationship between the negative time derivative of the enrichment factor and the rotary speed U. Below the predetermined rotary speed limit U grenz the time derivative $-(2A/2t)$ of the enrichment factor has a constant value C. This value C, which can be derived from the temperature of cooling water of the engine at the beginning of the after-starting phase, is invariable for all speeds below the value U grenz, as indicated by line 1 in FIG. 1. For any rotary speed above the limit value U grenz, the time derivative $-(2A/2t)$ is no longer constant but increases linearly with the increased speed U. Accordingly, for each rotary speed value above the speed limit a different graph is to be drawn in the diagram of FIG. 1.

Figure 3:
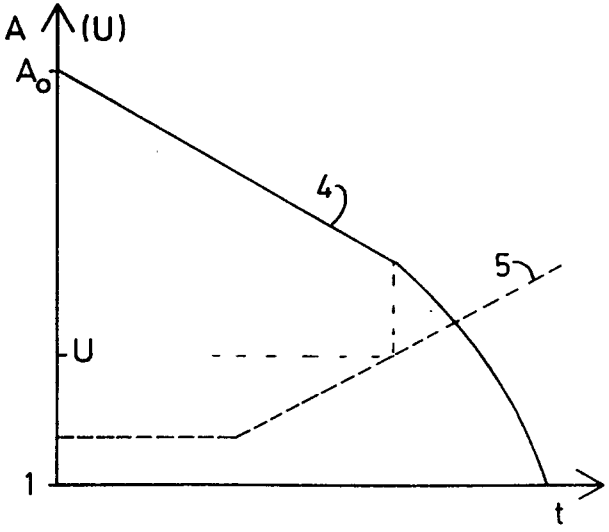
FIG. 3 is a time plot diagram of the enrichment factor at an increasing rotary speed.

FIG. 3 illustrates in full line 4 a time plot diagram of enrichment factor A in a case when rotary speed continuously increases from the idling speed up. The characteristic curve of the rotary speed is indicated by the dashed line 5. It will be readily seen that at a time point at which the rotary speed U reaches the limit value U grenz, the linear course of the line 4 transits into a curved line segment during which the enrichment factor A continuously decreases at a higher rate. It will be noted that in this illustration the line 5 is not a function of time.

Figure 4A:
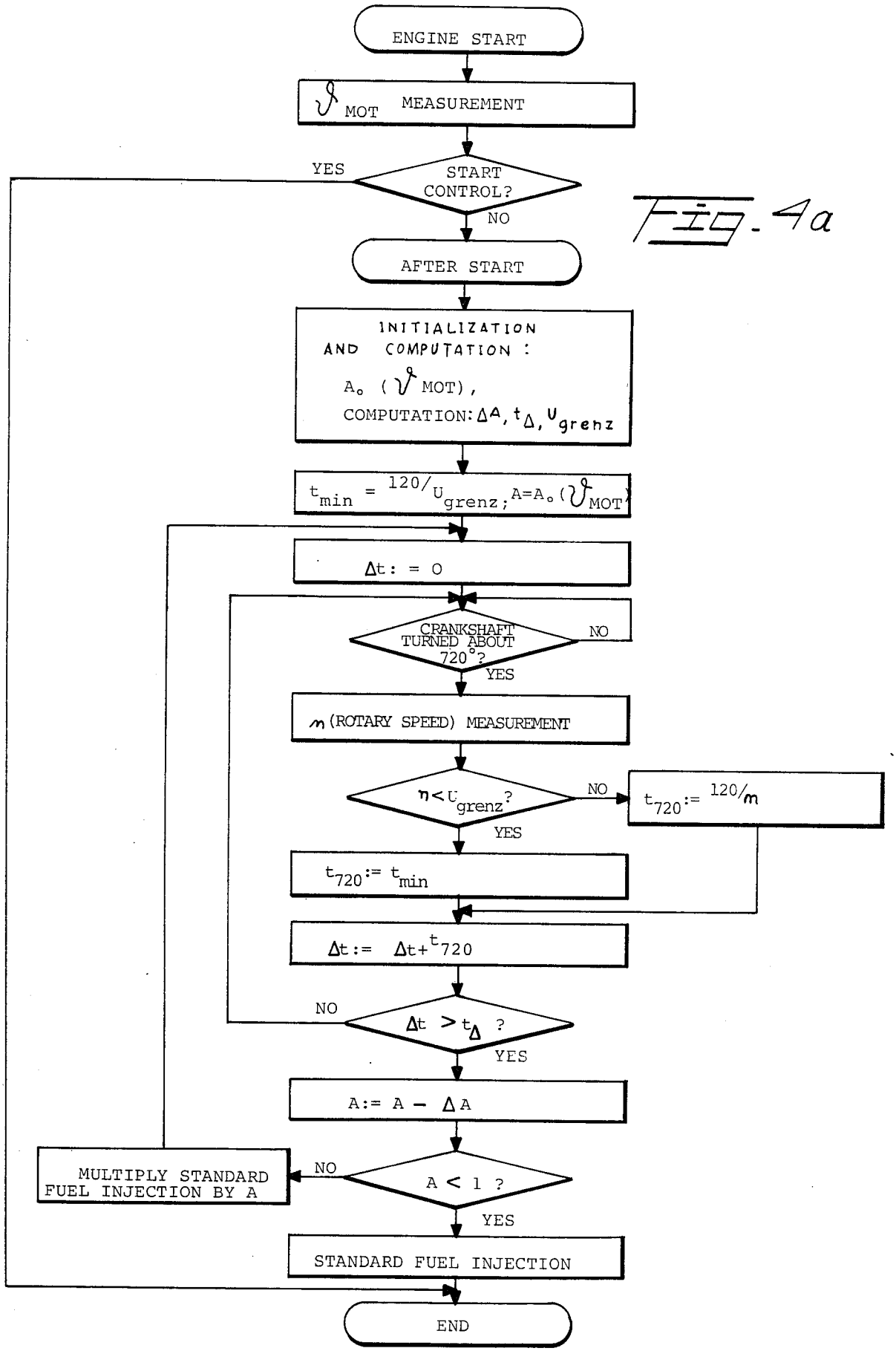
FIG. 4*a* is a flowchart for a computer controlled embodiment of this invention.

In the preferred embodiment of this invention, the fuel injection is controlled by a computer. FIG. 4*a* illustrates a flowchart of a computer controlled fuel injection system with an afterstart fuel enrichment dependent on temperature and rotary speed of the engine. In, this examplary algorithm, $\theta$MOT is engine temperature;

$A_o$ ($\theta_{MOT}$) is the initial value of the afterstart enrichment factor;

A is a momentary value of the after-start enrichment factor which, after the expiration of a time interval $t_{\Delta}t$ is to be reduced about a value $\Delta A$;

n is rotary speed of the engine;

$U_{grenz}$ is a rotary speed limit of the engine above which of the afterstart enrichment is to be reduced at a faster rate $t_{min}$ is a minimum time interval permissible for $t_{720}$.

In the algorithm it is assumed that fuel is injected in the engine every two engine revolutions, i.e. in all 720° positions of the crankshaft. Therefore, a time interval $t_{720}$ between two injections is determined as $t_{720}=120/n$. If fuel is injected once per a 360° position of the crankshaft, then the factor 120 is substituted by 60. The illustrated embodiment is valid for a timed fuel injection into one cyclinder. The other case (injection every 360° of crankshaft) relates to a conventional injection (L-jetronic).

If the algorithm is employed in connection with an injection control system of an n-cylinder engine, the factor 120 is to be substituted by 120/n.

It will be understood that each of the elements described above, or two or more together, may also find a useful application in other types of constructions differing from the types described above.

While the invention has been illustrated and described as embodied in a specific example of an enrichment control circuit, it is not intended to be limited to the details shown, since various modifications and structural changes may be made without departing in any way from the spirit of the present invention.

Without further analysis, the foregoing will so full reveal the gist of the present invention that others can, by applying current knowledge, readily adapt it for various application without omitting features that, from the standpoint of prior art, fairly constitute essential characteristics of the generic or specific aspects of this invention.

What is claimed as new and desired to be protected by Letters Patent is set forth in the appended claims:

1. A method of controlling after-start fuel enrichment of an internal combustion engine supplied with fuel-air mixture from an injection system including injection valves and an injection control circuit for delivering control pulses whose duration during the after-starting enrichment phase is increased to a value corresponding to the product of the duration of the injection pulses during the normal operational phase of the engine and an enrichment factor, the method comprising steps of setting the enrichment factor at the beginning of the after-starting fuel enrichment phase to an initial value $A_o>1$ depending on momentary temperature of the engine;

continuously reducing during the enrichment phase the enrichment factor at a constant rate toward a value $A=1$ while keeping a constant time derivative of the enrichment factor for all rotary speeds below a predetermined rotary speed limit; and when said speed limit is exceeded, continuously reducing the enrichment factor at a rate which increases proportionally with the increase of rotary speed.

2. A method as defined in claim 1 wherein for four-cylinder engines the rotary speed limit is between 3400 and 3800 rpm, preferably about 3600 rpm.

3. A method as defined in claim 1 wherein for five cylinder engines the rotary speed limit is between 2700 and 3100 rpm, preferably about 2880 rpm.

4. A method as defined in claim 1 wherein for six cylinder engines the rotary speed limit is between 2200 and 2600, preferably about 2400 rpm.

5. A device for controlling after-starting fuel enrichment of an internal combustion engine supplied with fuel-air mixture from an injection system including injection valves and an injection control circuit for delivering control pulses whose duration during the after-starting enrichment phase is increased to a value corresponding to the product of the duration of injection pulses during the normal operation of the engine and an enrichment factor A, comprising means for setting the enrichment factor at the beginning of the after-starting enrichment phase, to an initial value $A_o > 1$ depending on momentary temperature of the engine;

means for continuously reducing during the enrichment phase the enrichment factor at a constant rate toward a value $A = 1$ while keeping a constant time derivative of the enrichment factor for all rotary speeds lower than a predetermined rotary speed limit; and means for continuously increasing the rate of reduction of the enrichment factor in proportion to the increase of the rotary speed above said rotary speed limit.

* * * * *